US005688196A

United States Patent [19]

O'Neil

[11] Patent Number: 5,688,196

[45] Date of Patent: Nov. 18, 1997

[54] REMOTE CONTROLLED MOVING TARGET FOR PASSING PRACTICE

[76] Inventor: Kent D. O'Neil, P.O. Box T, Akron, Colo. 80720

[21] Appl. No.: 482,676

[22] Filed: Jun. 8, 1995

[51] Int. Cl.[6] ..... A63B 67/00

[52] U.S. Cl. ..... 473/439

[58] Field of Search ..... 273/55 R, 332, 273/333, 359, 360, 366, 367, 369, 370, 371, 374, 375–376, 389, 390, 407

[56] References Cited

U.S. PATENT DOCUMENTS

| | | | |
|---|---|---|---|
| 650,008 | 5/1900 | Hamel | 273/359 |
| 2,398,813 | 4/1946 | Swisher | 273/369 |
| 2,793,038 | 5/1957 | Wallace | 273/369 |
| 3,140,874 | 7/1964 | Jensen | 273/369 |
| 3,573,867 | 4/1971 | Mehren | 273/359 |
| 3,637,210 | 1/1972 | Brantley | 273/55 |
| 3,659,848 | 5/1972 | DePew | 273/55 |
| 4,081,056 | 3/1978 | Siitonen | 273/369 |
| 4,385,767 | 5/1983 | Colbourne | 273/359 |
| 5,100,153 | 3/1992 | Welte | 273/359 |
| 5,220,358 | 6/1993 | Jones | 273/369 |

FOREIGN PATENT DOCUMENTS

| | | | |
|---|---|---|---|
| 511066 | 10/1992 | European Pat. Off. | 273/359 |
| 4031937 | 4/1992 | Germany | 273/359 |
| 660782 | 6/1987 | Switzerland | 273/359 |
| 751874 | 7/1956 | United Kingdom | 273/359 |

*Primary Examiner*—Theatrice Brown

*Attorney, Agent, or Firm*—Ramon L. Pizarro; Edwin H. Crabtree

[57] ABSTRACT

A portable, remote controlled moving target device for throwing practice which includes a support cable for supporting and carrying a target on an adjustable target support. The adjustable target support includes a hollow upper stem portion and a hollow lower stem portion with a spring within the hollow stem portions that forces the two stem portions together and allows the user to adjust the position the angle or position between the target and the support cable. The adjustable target support is pulled along the support cable by an endless cable loop that is driven by a motor. A remote control transmitter and receiver are used for controlling the motor so that a player or user can interact with the target device and stop and reverse the motion of the target from the field, and thus allows the player to repeat target plays as desired or quickly stop the motion of the target in the event of an emergency. The entire device only uses two vertical supports that can easily be taken down and reassembled in a new field for practice.

11 Claims, 7 Drawing Sheets

REMOTE CONTROLLED MOVING TARGET FOR PASSING PRACTICE

BACKGROUND OF THE INVENTION (a) Field of the Invention

This invention generally relates to a remote controlled moving target and target drive mechanism for throwing and passing practice, and more particularly, but not by way of limitation, to a portable, remote controlled target and target drive mechanism for practicing the throwing of a football.

(b) Discussion of the Prior Art

Football is perhaps the most popular sport in the United States. Americans begin to play the game at an early age, with many youngsters participating in organized pee-wee football leagues and the like. A child's involvement in the sport allows the child to develop a competitive attitude and a discipline for preparation for developing their skills and talents. Thus playing and practicing for the game allows youths to develop high self esteem and discipline.

One of the most important skills required for playing football is precise, coordinated throwing. Good throwing skills allow a player to complete passes to other player, which can in turn be essential to winning a game. Because of the importance of throwing skills, players, especially young players, try to develop and hone their football throwing skills through practice. This practice helps develop the player's throwing skills as well as an understanding of the value of training, discipline, perseverance and hard work through practice. The youth's association of the value practice and the resulting improved skills is reinforced if the youth has the opportunity to practice and if the youth can see the improvements or fruits of their hard work.

Thus, it is important to provide players with the opportunity to practice with equipment that will allow them to develop their skills in an effective manner. It is important, therefore, to provide a training tool that allows the player to focus on a particular skill, so that the player can practice that skill and quickly see the results of that practice. This need is particularly acute with regards to the development of throwing skills.

Throwing skills involve hand-eye coordination, fast reflexes and strength. All of these abilities can be developed by providing the proper exercise equipment that allows the youth to practice throwing at a variety of speeds and directions. The need for this equipment has been recognized, and several attempts have been made to provide machines that allow youths to practice their throwing skills. For example, U.S. Pat. No. 4,936,578 to Hudson, Sr. teaches the use of a vertical pole with horizontal arms and pass throwing target loops located a positions that represent passing levels or areas frequently targeted when passing. The Hudson device is limited, however, primarily because it is a stationary target. Stationary targets do not offer the added advantage of moving targets in that they do little to improve the player's ability to coordinate passes to a moving player.

Yet another target device, U.S. Pat. No. 4,826,166 to Baker et al., teaches the use of a frame section with a target that swings on a cantilevered boom that allows limited motion of the target in front of the frame section. One of the important features of the Baker invention is that the target provides side to side motion. The object of this side to side motion is to allow the user to develop motion/aim coordination. The device is limited, however in that only short, side to side movements are possible with the invention. Also, these short movements are not representative of the actual movements encountered during a game, and therefore are not of great help in training for throwing a football at a moving, or running, target as will be encountered during a game.

In yet another invention, U.S. Pat. No. 4,700,952 to Patsy an underground mechanism is taught for providing a moving target for a soccer player. In a related patent, U.S. Pat. No. 4,645,210 to Patsy, an apparatus that can be used as an above ground target is taught. The Patsy device taught in the '210 patent is a portable motorized system that includes a moving target that moves between two housed pulley systems. One of the pulley systems includes a drive motor, which is controlled by a programmable control unit and circuitry that prompts the reversal of the drive motor once a predetermined change in electrical load is experienced by the drive motor circuitry. Therefore, the Patsy device claimed in the '210 patent teaches an innovative system for controlling reversal of the direction of motion of a target that is suspended and driven by a cable.

The Patsy devices are directed at providing a moving target for soccer practice, however. Therefore, the Patsy devices are designed to move targets that mimic the movements of a soccer player, and are thus attached to the motor means in a manner that best mimics the a size and configuration of a target encountered in a soccer game. Moreover, the Patsy devices include somewhat complicated drive mechanisms that is especially well suited for moving small targets that mimic soccer situations. Still further, the Patsy devices do not allow interaction between the player and the target so that the player may interactively control the speed and direction of travel. This means that if the user misses a particular throw at a specific distance, speed or position that the user wishes to perfect, then the user must wait for device to go through one complete cycle of operation before the user gets to try the toss again. This kind of waiting can be inconvenient and reduce the efficiency of the use of practice time and even discourage training.

In another invention, U.S. Pat. No. 3,823,939 to Bottorff, an un-motorized portable moving target for football throwing practice is taught. The Bottorff device includes a vertical hoop type target mounted on a carriage that rides on an inclined track. Because the target of the Bottorff invention rides on a rigid track, several supports must be used along the track in order keep the track at an angle that will allow the carriage to move. Also, the use of a carriage that is driven by gravity can result in a slow moving target. Moreover, the lack of a motor means that the carriage will move by gravity in only one direction, forcing the user to walk to the end of the track to retrieve the carriage every time the user wants to practice another throw. Yet another disadvantage of gravity actuated devices is that the speed of the moving carriage will always be the same and thus limit the variety of passing scenarios practiced.

In yet another invention, U.S. Pat. No. 3,810,618 to Nedwick, a football quarterback trainer with an attachable target unit is taught. The Nedwick device includes a set of frames on wheels and fabric sheets that include holes or pockets that serve as targets. While the Nedwick device is simple and portable it does not provide the essential dynamic action that is needed for developing good throwing skills. Moreover, the user must walk around the target in order to vary the angle between the player and the target. In other words, if a player wants to increase the difficulty of hitting the target, the player must walk around the target until the desired angle is achieved.

Another approach at providing a target for football tossing practice is taught by U.S. Pat. No. 3,680,862 to Russell et al.

The Russel patent discloses a football target practice device that allows the user to practice kicking as well as passing. The Russell device includes a passing practice feature with a figure shaped like a football player that is about to catch the ball and a target that represents the optimal area to toss the ball to a such a player. One of the most important limitations of the Russell invention is that it does not provide means for allowing the development of skills for tossing the ball at a moving target. Also, the Russell device does not allow adjustment in order to vary the angle of the target, and thus requires that the user walk around the target in order to face a different angle. Yet another limitation of the Russell device is that it does not allow interaction or any other kind of instantaneous response to user control or input.

Other attempts at providing targets for aiding in the development of throwing skills include U.S. Pat. No. 3,533,624 to Miller. The Miller patent provides a portable target device with a swinging target. The Miller device has desirable features that it is portable and provides a moving target. However, the Miller invention suffers from limitations in that it does not instantaneously respond to player control. Also, it does not provide much motion since the target only swings back and forth, presenting a limited range of motion and variations in tosses or game situations practiced.

There remains, therefore, a need for a need for a target device that is particularly useful in practicing the tossing of a ball at a moving target as is required in the game of football. More importantly, there remains a need for a moving target device that allows a user to interact with the device while practicing. Moreover, the need for a portable moving target device that allows the user to vary the angle of target, and then interact with the device by controlling the speed and direction of motion of the target has yet to be satisfied.

SUMMARY OF OBJECTS AND FEATURES

A remote controlled moving target device that satisfies the above needs has been invented and is disclosed in this specification. The remote controlled moving target device is particularly useful for practising the tossing of a ball, such as a football, at a moving target. A preferred version of the invention includes a support cable with an adjustable target slidably mounted on the support cable, a motor driven endless cable loop that attaches to the adjustable target, a remote control receiver that controls the operation of the motor, and a portable remote control transmitter that can be carried by the user so that the user, or as also referred to herein as the player, can interact with the device. The remote control feature allows the player to interact with the device and control the motion of the target through the use of the remote control transmitter while training.

The support cables and motor driven endless loop can preferably be mounted between two supports, thereby allowing the device to become portable, allowing its use of the device in any open field. Also, the adjustable target can be set at different positions or angles relative to the support cable. The angular adjustments enhance the realism of the throwing practice. A user may set the target at a particular angle so that the target makes a right angle relative to the player or user at a specific distance from the player. This feature is particularly useful in developing the timing and coordination skills of quarterbacks, for example. In real game situations the quarterback will have a brief instant in which he or she can toss a pass that will not be blocked or intercepted and that can be caught by the targeted receiver. The adjustable target of the instant invention will move along the support cable quickly and then, for an instant, present the most opportune target cross-section to the player; it is at this instant that the player must hit the target.

If the player throws the ball and misses, he or she can immediately practice the same throw once again. The player or user can stop the target by simply pressing a button on the remote control transmitter, which can be conveniently worn on the player's clothing. Another press of a button and the transmitter will prompt the target to reverse its direction of travel until it reaches the end of the support cable or until the player once again presses a button on the remote control. By pressing a button on the remote control the player can cause the target to stop again, and another press will allow the target re-execute the same motion routine as had just been practiced and missed.

Perhaps even more importantly, the fact that the player can interact with the device greatly enhances the safety of this invention over the prior art. For example if a the user does not notice that there is a small child in the area, and that child happens to run in front of the moving target out of curiosity, the user can immediately stop the motor to avoid hitting the child with the moving target.

In order to move the target along the support cable the device preferably includes an electrical motor that is connected to a motor control unit that can direct electrical energy to the motor. The motor control unit is configured so that it will direct electrical energy to drive the motor in one direction or in the reverse direction. The motor control unit can also completely disconnect the electrical energy to the motor and simultaneously switch the leads from the motor to a resistor. This is done to provide for stopping of the target by means of electrical resistance.

Because of the momentum gained by the moving target and moving target drive mechanism when it is in motion, the target and target drive mechanism will continue to move once electrical power to the motor is disconnected. Therefore, a braking means is required for stopping the target. In a preferred embodiment, the invention uses electrical resistance to help stop the moving target. As is well known, an electric motor will generate electricity if it is turned or driven by an external mechanical force, such as the force provided by the momentum of the moving target. Therefore, the motor control unit is designed to connect the motor's electrical terminals to a resistor when it disconnects the electrical energy to the motor. This will cause electrical power generated by the motor due to the momentum of moving target to be dissipated through the resistor and the motor's armature, which will in turn cause the target to stop or slow down significantly.

In a preferred embodiment a motion management unit is also connected to the motor control unit. The motion management unit responds to control signals from the remote control receiver and can be programmed or set to control the electrical current supplied to the control unit. The motor control unit will in turn allow this current (voltage) to drive the motor in a forward direction, a reverse direction, or disconnect the current to the motor and direct the regenerated current to flow back through the the motor armature.

Thus it can be appreciated that it is an object of this invention to provide a portable moving target that is particularly useful for developing throwing skills.

It can also be readily appreciated that it is another object of this invention to provide a moving target that can be adjusted to vary the angle of the target presented to the player.

It is yet another object of the instant invention to provide a moving target device that allows varying the angle of a moving target to enhance the development of timing when throwing.

It is yet another object of the instant invention to provide a portable moving target device that allows the user to interact and control the target device by remote control.

It is yet another object of this invention to provide a device that allows a user to maximize the efficiency of the time spent training by allowing the user to control the motion of the target device from the field.

It still another object to provide an adjustable moving target for training quarterbacks or other athletes that need to throw a ball or the like at a moving target.

It still another object to provide a moving target with enhanced safety control characteristics that allow the user to stop the operation of the device the instant the user sees that someone or something gets in the way of the moving target.

Thus the described remote controlled target for throwing practice offers advantages in operation, simplicity, manufacturability, and effectiveness that could not be achieved by the prior art. While these and other advantages and objects of the present invention will become apparent to those skilled in the art from the following detailed description and accompanying drawings, showing the contemplated novel construction, combinations and elements as herein described, and more particularly defined by the appended claims, it should be understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, it is to be understood that the description is not intended to limit the invention strictly to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
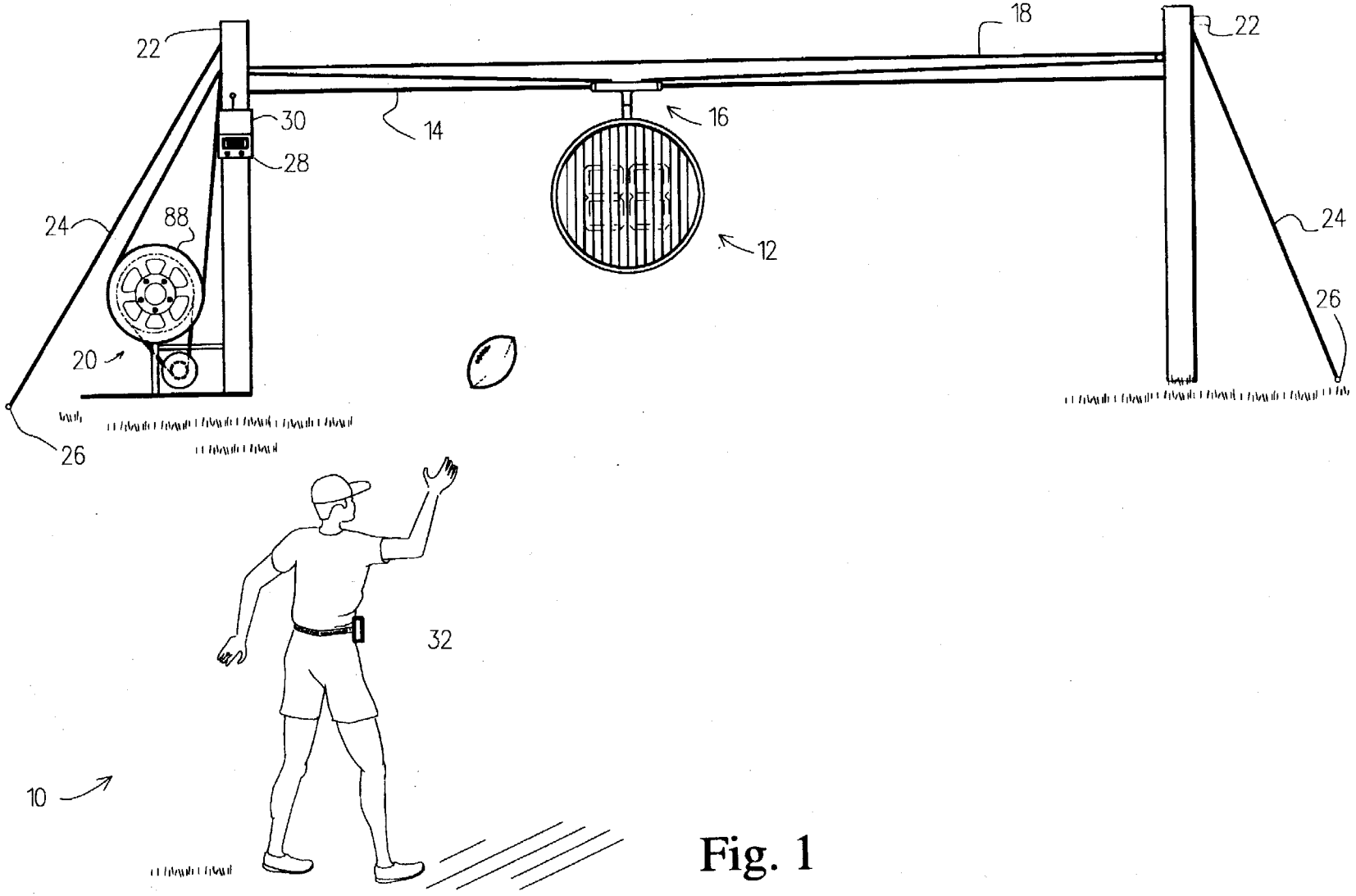
FIG. 1 is an elevational view of the device in use for football throwing target practice with the target at position that is substantially parallel to the support cable.

In FIG. 1 an installed preferred embodiment of the subject invention, a remote controlled moving target device, is shown having a general reference numeral 10. As can be observed from FIG. 1, the invention includes a target 12, or target means, that is mounted on a support cable 14, or first cable means, by means of a target adjustable support 16. The target adjustable support 16 serves as a means for suspending the target 12 on the support cable 14. In order to move the target 12, mounted on the target adjustable support 16, an endless loop 18 is attached to the target adjustable support 16. The endless loop 18 may preferably be made of cable, and is in turn driven by a motorized drive system 20. Thus, the endless loop 18 serves as cable means for driving the target 12 along the support cable 14. The support cable 14 is preferably mounted on a pair of vertical supports 22, which are supported by tension cables 24, each of which have been attached to the ground by means of a stake 26. The use of single posts for vertical supports 22 allows the invention 10 to be easily taken down and re-installed where desired. Thus it is envisioned that the invention 10 as disclosed here can be easily disassembled, transported and set up in a new location, and the invention 10 can thus be fairly categorized as being portable.

Attached to the vertical support 22 that is closest to the motorized drive system 20 is a motion management unit 28 that is in turn controlled by a remote control receiver 30. The remote control receiver 30 responds to signals sent by a user, or player, by means of a remote control transmitter 32.

Figure 2:
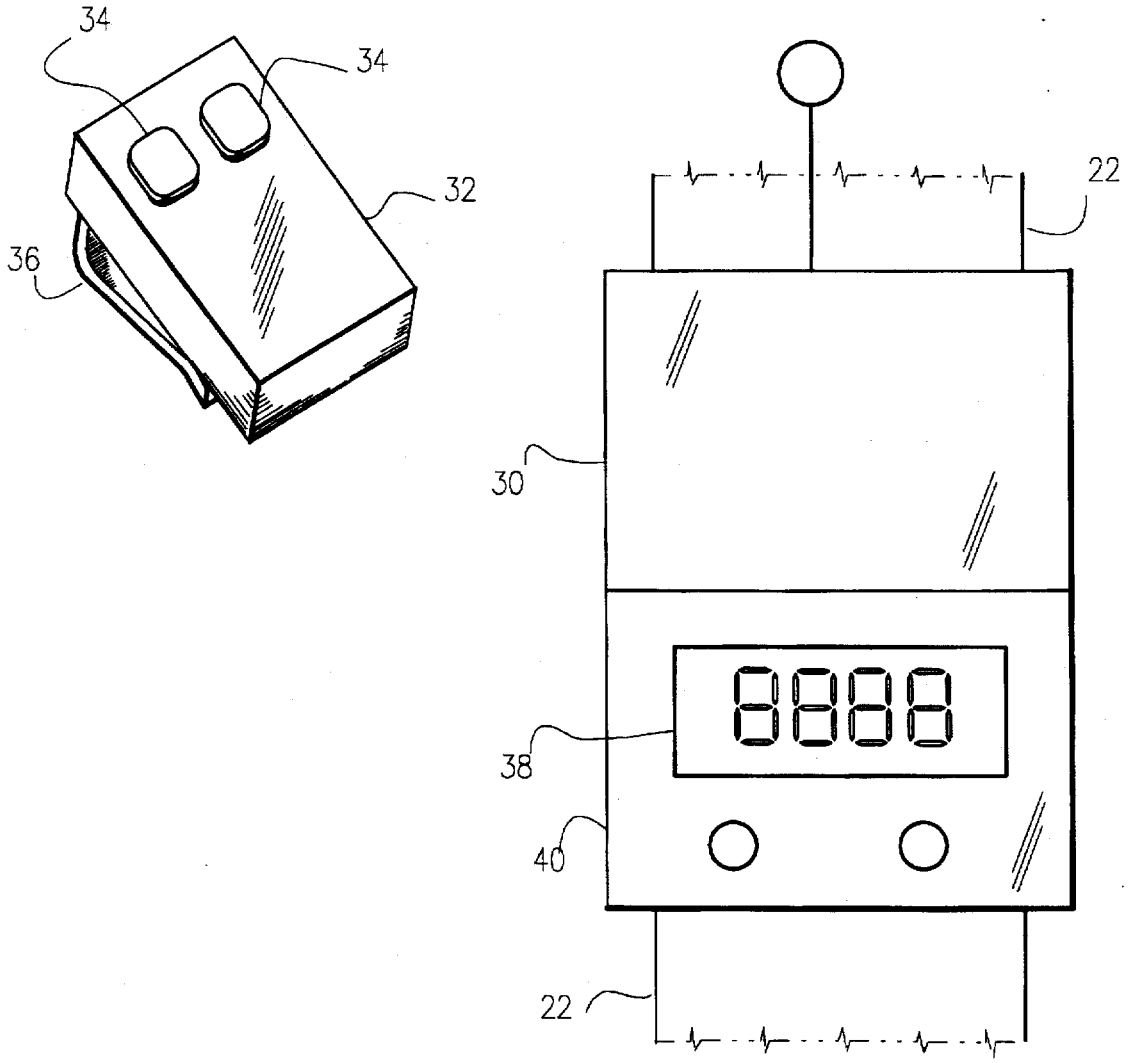
FIG. 2 is a close-up of the remote control transmitter, receiver and motor motion management unit.

As is shown on FIG. 2, the remote control transmitter 32 preferably has push buttons 34 and an attachment clip 36. This enables the user to attach the remote control transmitter 32 to the user's clothing as is shown on FIG. 1. The push button arrangement shown on FIG. 2 can serve to signal and control many functions. For example, one press of one of the buttons 34 can signal the remote control receiver 30 to have the motion management unit 28 stop the operation of the motorized drive system 20. Another press of the same push button 34 can signal the remote control receiver 30 to once again start the operation of the motorized drive system 20. Similarly, a player could control the direction of travel with just two buttons 34. One press of one of the buttons can signal to the remote control receiver 30 to have the motor control stop the motorized drive system 20; then a press of the second push button 34 can signal the reversal of the direction of drive by the motorized drive system 20, and another press of the push button 34 used to stop the motorized drive system 20 will cause the motorized drive system 20 to start again, this time driving the target in the reverse direction.

The toggling and reversal of drive direction will be described in more detail below. However, it should be emphasized here that there are many different well known electronic means for achieving this toggling and reversal of direction of drive. The remote control transmitter 32 may even include more push buttons for signaling other commands to the remote control receiver 30. For example, the motion management unit 28 may have several preprogrammed routines each of which may be activated by pressing a different push button on a transmitter that is similar to the remote control transmitter 32 described here. In a preferred embodiment discussed here, only two buttons have been included in the remote control transmitter 32. Two push buttons have been used in this embodiment because the reduction of the number of buttons is considered to make the use of the invention easier and more intuitive. However, it is important to note that the use of more buttons is anticipated in the event of including a variety of pre-programmed routines in the control system of the motion management unit 28.

FIG. 2, shows that the motion management unit 28 of a preferred embodiment of the invention 10 includes a digital display 38 and control settings 40. In a preferred embodiment the control settings 40 are used for setting the maximum speed of travel of the target 12. This speed can be displayed by the digital display 38.

Figure 3:
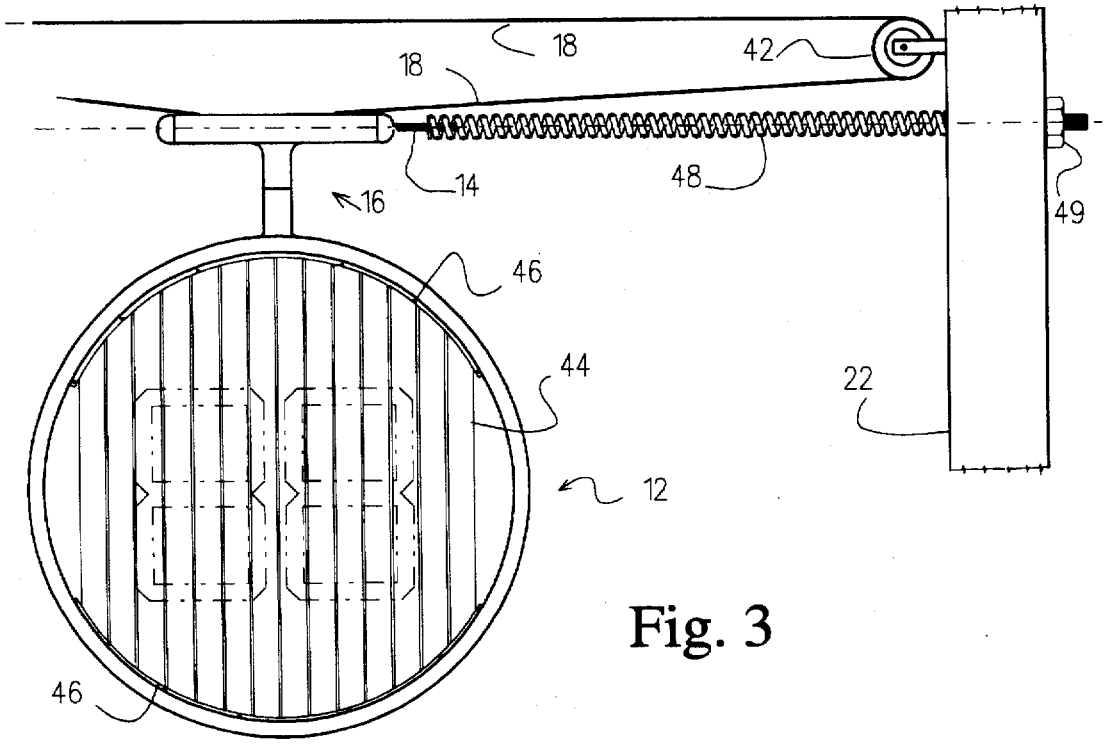
FIG. 3 is an elevational view of an end of the target as it approaches an end of the support cable.

Turning now to FIG. 3, which shows the target 12 on the target adjustable support 16, which in turn is mounted on the support cable 14. The target adjustable support 16 is pulled by cable of the endless loop 18. The endless loop 18 is suspended on the supports 22 by means of pulleys 42. A preferred embodiment of the target 12 also includes several flexible strips 44 which serve as a stop for a ball that is thrown at the target 12 as it is pulled by the endless loop 18. In a preferred embodiment the strips are set side by side as shown on FIG. 3, and a figure or a number may be printed on the strips to enhance the realism of the target 12. The strips 44 are mounted to the target 12 by a strip attachment means 46, which can be a pair of substantially rigid bands that are mounted on the target and serve to sandwich the strips 44 between the bands.

Also shown on FIG. 3 is a stop spring 48 that is mounted on the support cable 14 near an end of the support cable 14, where the support cable 14 attaches to the vertical support 22. The support cable 14 simply runs through the stop spring 48 before attaching to the vertical support 22. The stop spring 48 helps stop the motion of the target 12 as it reaches the end of the support cable 14.

As shown on FIG. 3, the support cable 14 attaches to the vertical support 22 by means of a cable clamping means 49. Cable clamping means 49 can be one many well known devices such as U-bolts, bolts, clamps and the like.

Figure 4:
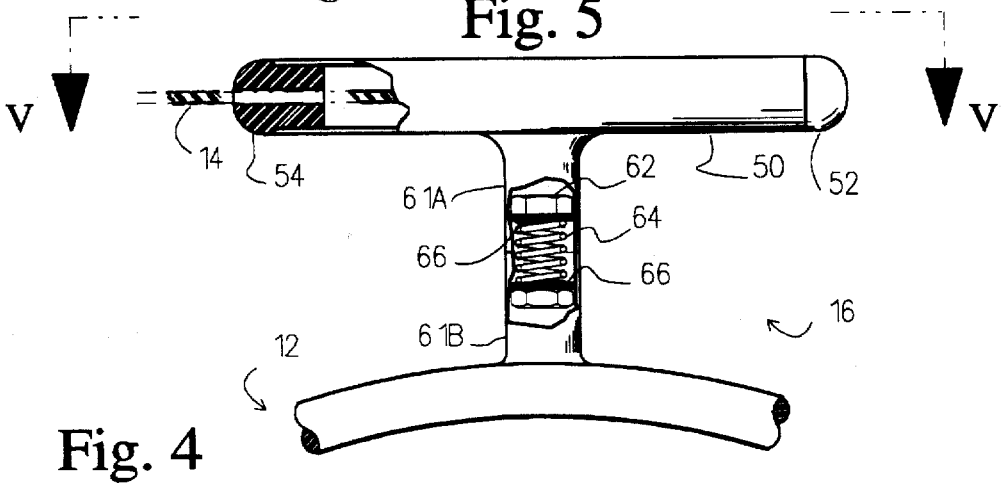
FIG. 4 is a side view of the target mounting arrangement that allows variation of the angle of the target.

As is shown on FIG. 4, the target adjustable support 16 preferably includes a longitudinal body 50 in which can be attached friction reducing target support ends 52. The target support ends 52 are preferably members that fill the ends of the longitudinal body and are made of a solid piece of plastic material such as nylon, which provides low frictional resistance as it slides over the support cable 14. The target support ends preferably can be press fit into the longitudinal body 50 and include a passage 54 for accepting the support cable 14.

Figure 5:
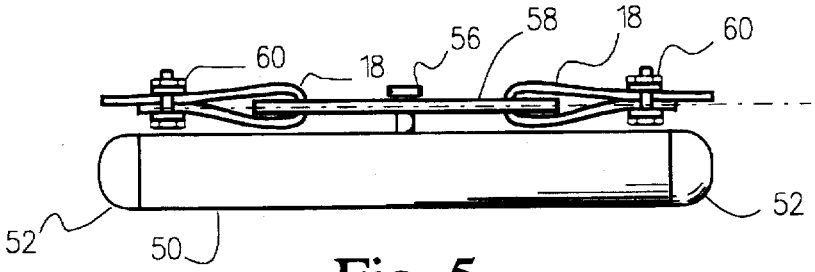
FIG. 5 is a top view of the target mounting arrangement, showing the attachment of the motor driven endless loop to the target adjustable support.

FIG. 5 shows that attached to the longitudinal body 50 is a means for attaching the endless loop 18. In an embodiment of the invention 10, the attachment means is made up of a pivot pin 56 that is attached to the longitudinal body 50. Pivotally mounted on the pivot pin 56 is an endless loop attachment means 58 for attaching the endless loop 18 to the attachment means 58. The endless loop 18 is preferably attached to the attachment means 58 by means of a clamping means 60. Obviously, the endless loop 18 could be attached to the longitudinal body 50 by means of one or more lugs or flanges (not shown) that are rigidly attached directly to the longitudinal body 50, instead of attaching the endless loop 18 to an endless loop attachment means 58 that is mounted on a pivot pin 56.

Also shown on FIG. 4 is the adjustment mechanism that is included in the target adjustable support 16. The adjustment mechanism is a means that allows the setting of the target 12 at various different angles relative to the support cable 14. The adjustment mechanism includes a split vertical stem 61 that includes an upper stem portion 61A and a lower stem portion 61B. Retention walls 62 in the upper stem portion 61A and the lower stem portion 61B serve as retention means for a bolt 64 that extends through the retention walls 62 and squeezes a spring 66 between the retention walls 62. This arrangement allows the spring 66 to bias the lower stem portion 61B against the upper stem portion 61A. The bias prevents relative motion between the upper stem portion 61A and the lower stem portion 61B, and allows the user to set the angle of the target 12 relative to the support cable 14.

An example of the many advantages of the target adjustable support 16 can be appreciated if the user has been practicing tossing a ball at the target 12 with the target 12 set parallel to the support cable 14. In this position user will most likely practice throws at the target 12 as the target 12 moves at right angles to the front of the player. In other words, the player is likely to throw at the target 12 as it moves past the player in a direction parallel to the player's shoulders. Thus, when the target 12 is set parallel to the support cable 14, the player is likely to throw at the target in a direction that is normal to the support cable as the target 12 passes directly in front of the player. The player is likely to toss in this normal direction simply because if the target 12 is set parallel to the support cable 14, then the target will present the best, or broadest, target as the target 12 passes through a point that lies along a line that is normal to the support cable and passes through the player.

In real football game situations a pass receiver rarely runs directly across the field in front of the quarterback. The most likely passing situation will include a receiver whose motion includes component that can be characterized as being directly across the field, perpendicular to the length of the field, and another component that can be characterized as being directly down the field (along its length). The adjustment capabilities of the instant invention 10 allows the user or player to simulate this kind of motion by setting the target 12 at an angle to the support cable 14. Thus, with the instant invention the player can practice throws at target that moves in a realistic fashion with motion both along as well as across the field. The realistic simulation that can be achieved with the instant invention 10 can uts produce better, and more efficient, training than could be achieved with the prior art.

Figure 8:
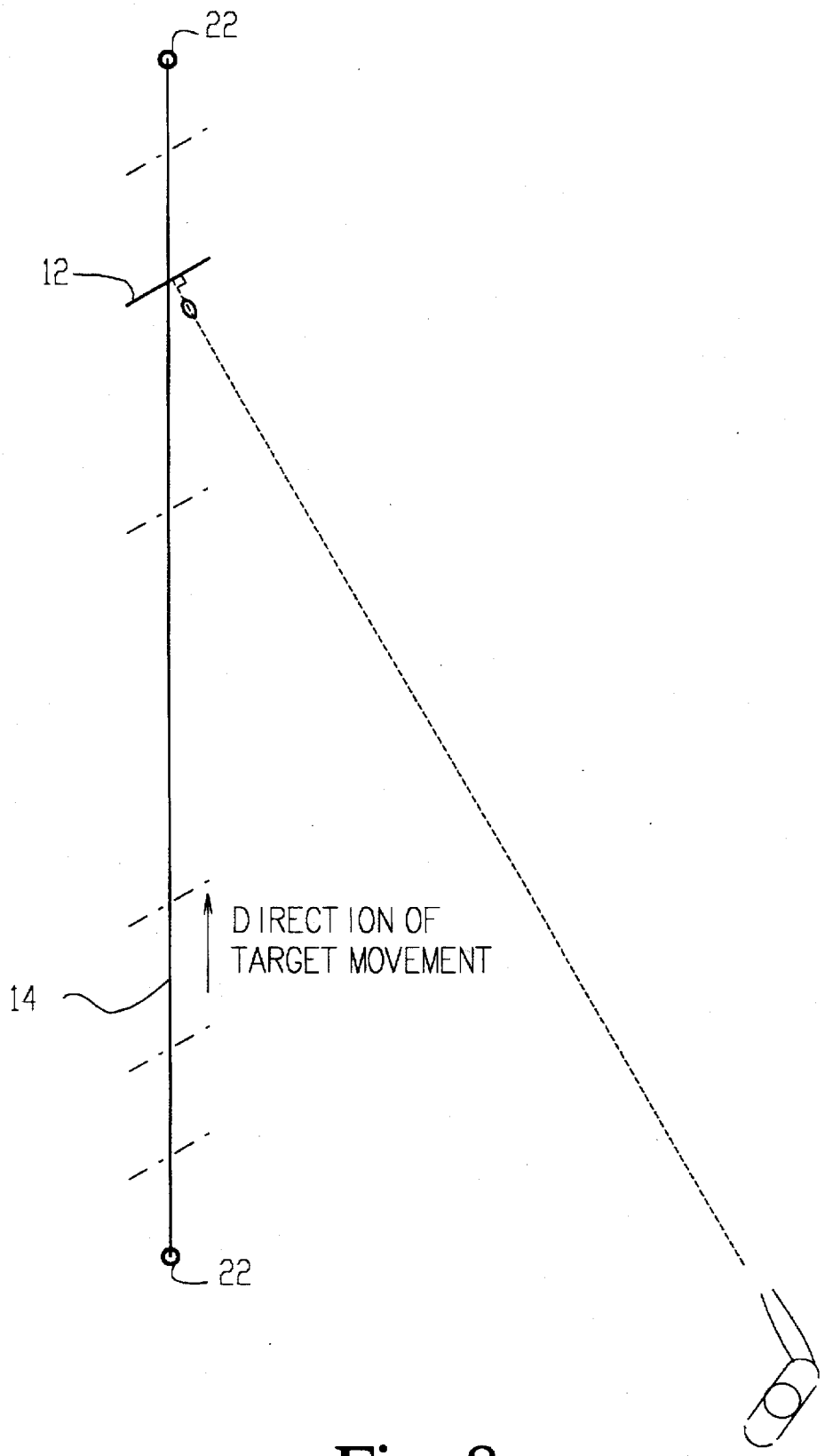
FIG. 8 is a plan view of a possible angled setting of the target and showing how an angled setting can briefly present the most opportune target cross-section to the player.

A possible game situation simulation is illustrated in FIG. 8, where by setting the angle of the target 12 relative to the support cable 14 at, say, thirty degrees the player can practice a pass that mimics the motion of a receiver that is running down the field at an angle of thirty degrees to the length of the field. As the target 12 moves along the support cable 14 in this setting, the target will pass through a point on the support cable 14 where the surface or face of the target 12 is at ninety degrees to the player. Thus, the player must attempt to have the ball strike the target at this instant in order to maximize the chances of hitting the target. Therefore the adjustability of the target provides a means for mimicking the real game situations where the receiver is running away, at an angle to the quarterback, and presents a brief optimal instant in which the receiver can actually catch the pass thrown by the quarterback; thus greatly advancing the realism of pass practice.

Figure 6:
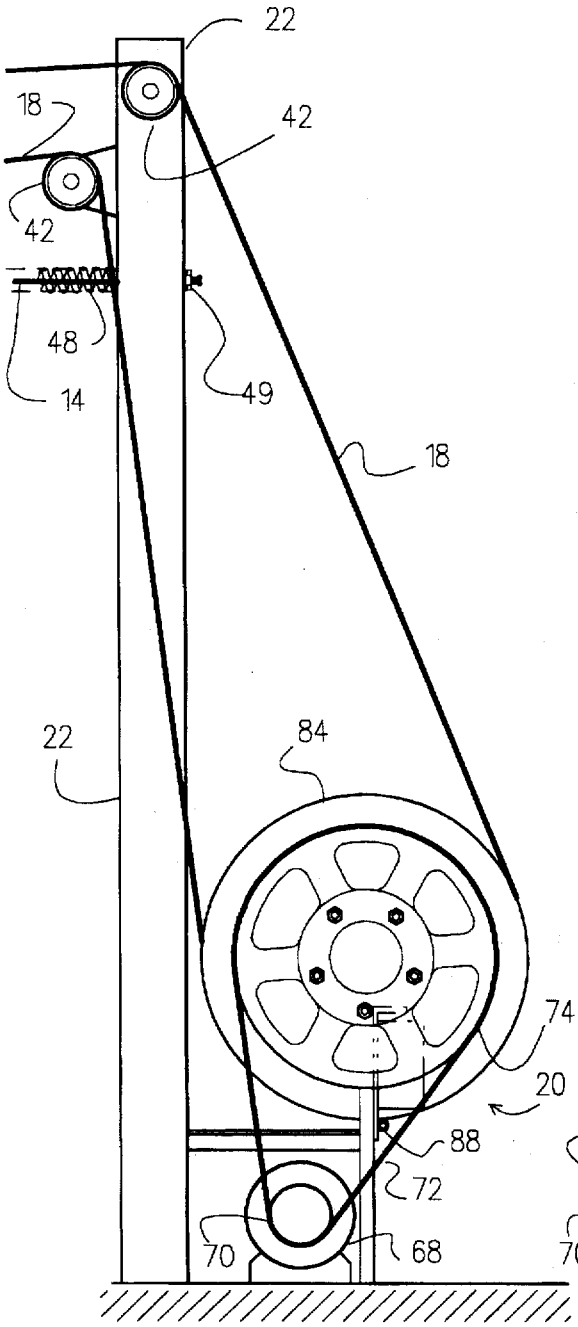
FIG. 6 is a side elevational view of the drive mechanism and pulley system for the motor driven endless loop.

Illustrated in FIG. 6 is a side view of the motorized drive system 20. The motorized drive system includes a drive motor 68, which is preferably a direct current motor, and a motor pulley 70 that is mounted on to the drive motor 68. Mounted on the motor pulley 70 is a drive belt 72 that drives a driven pulley 74. The driven pulley 74 is attached to a drive shaft 76 that is mounted on a pair of shaft bearings 78.

Figure 7:
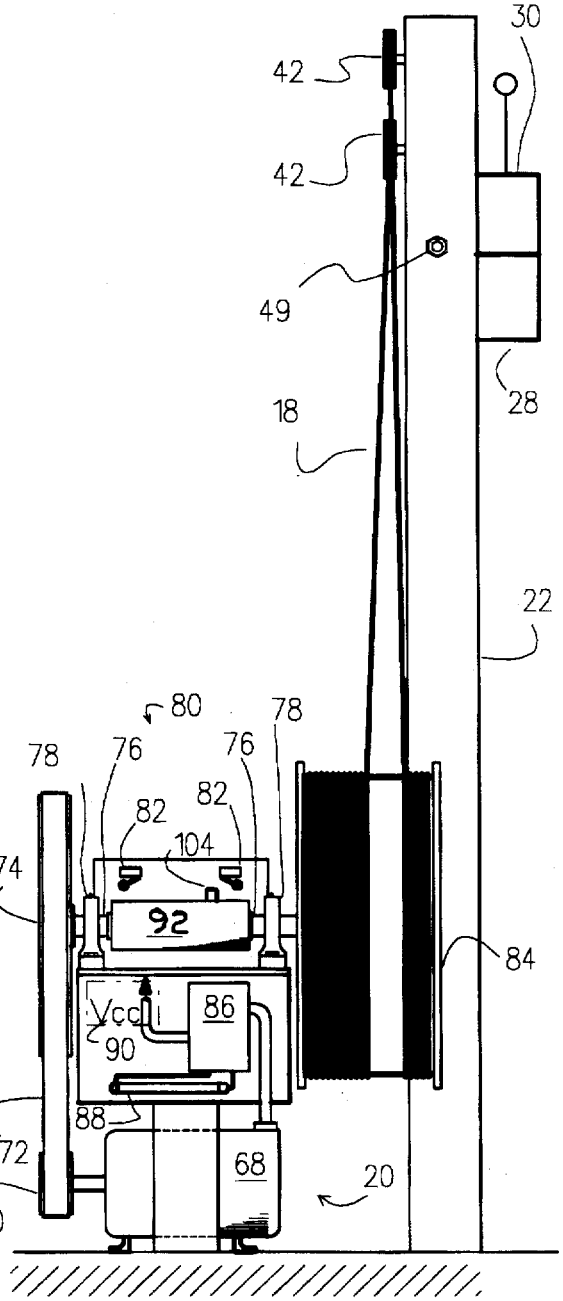
FIG. 7 is a end elevational view of the drive mechanism and pulley system for the motor driven endless loop.

In FIG. 7, it can be seen that operating off of the drive shaft 76 is a threaded limit switch triggering means 80 that triggers a pair of limit switches 82 in that send a signal to disconnect electrical power to the motor 68 when the target 12 is near the stop spring 48.

Also mounted on the drive shaft 76 is an endless loop drive wheel 84. The endless loop 18 is wound around the endless loop drive wheel 84 in a manner that permits unwinding of one portion of the endless loop 18 while winding another portion of the endless loop onto the endless loop drive wheel 84.

As can be seen in FIG. 7, the invention also includes a motor control unit 86 that responds to signals from the motion management unit 28 as well as signals from the limit switches 82. The motor control unit 86 is a motor control means that switches power to the motor 68, switches the polarity of the current to the motor 68, and switches the electrical connection from the motor 68 in order to electrical resistance breaking of the target 12. The switching can be accomplished with many well known devices, such as latching relays (not shown) which lock the circuit into providing a desired polarity of voltage to the motor 68 depending on the desired direction of rotation of the motor 68. This arrangement allows reversal of the direction of travel of the target 12 by reversing the direction of rotation of the motor 68. Obviously, other means for reversing the direction of motion of the target 12 can be employed. For example, a solenoid actuated, geared mechanism could be used if a motor that could only rotate in one direction were implemented.

In addition to controlling the switching of the direction of rotation of the motor 68, the motor control unit 86 can also switch the electrical connections to the motor 68 so that electrical resistance breaking can be used to slow down or stop the motion of the target 12. To do this, the motor control unit 86 disconnects electrical power to the motor 68 and electrically connects the motor 68 to a resistor 88. Therefore, a signal from the motion management unit 28 can cause the motor control unit 86 to switch electrical power from a power source 90 to an open position and simultaneously electrically connect the motor to the resistor 88. This takes advantage of electrical resistance breaking that can be achieved by converting the mechanical energy stored in the moving target into electrical energy by allowing the momentum of the target 12 to turn the rotor of the motor 68 and thus generating electricity with the motor 68. As is well known, breaking can be achieved by dissipating this electrical energy through the resistor 88 and the motor's 68 armature.

Figure 9:
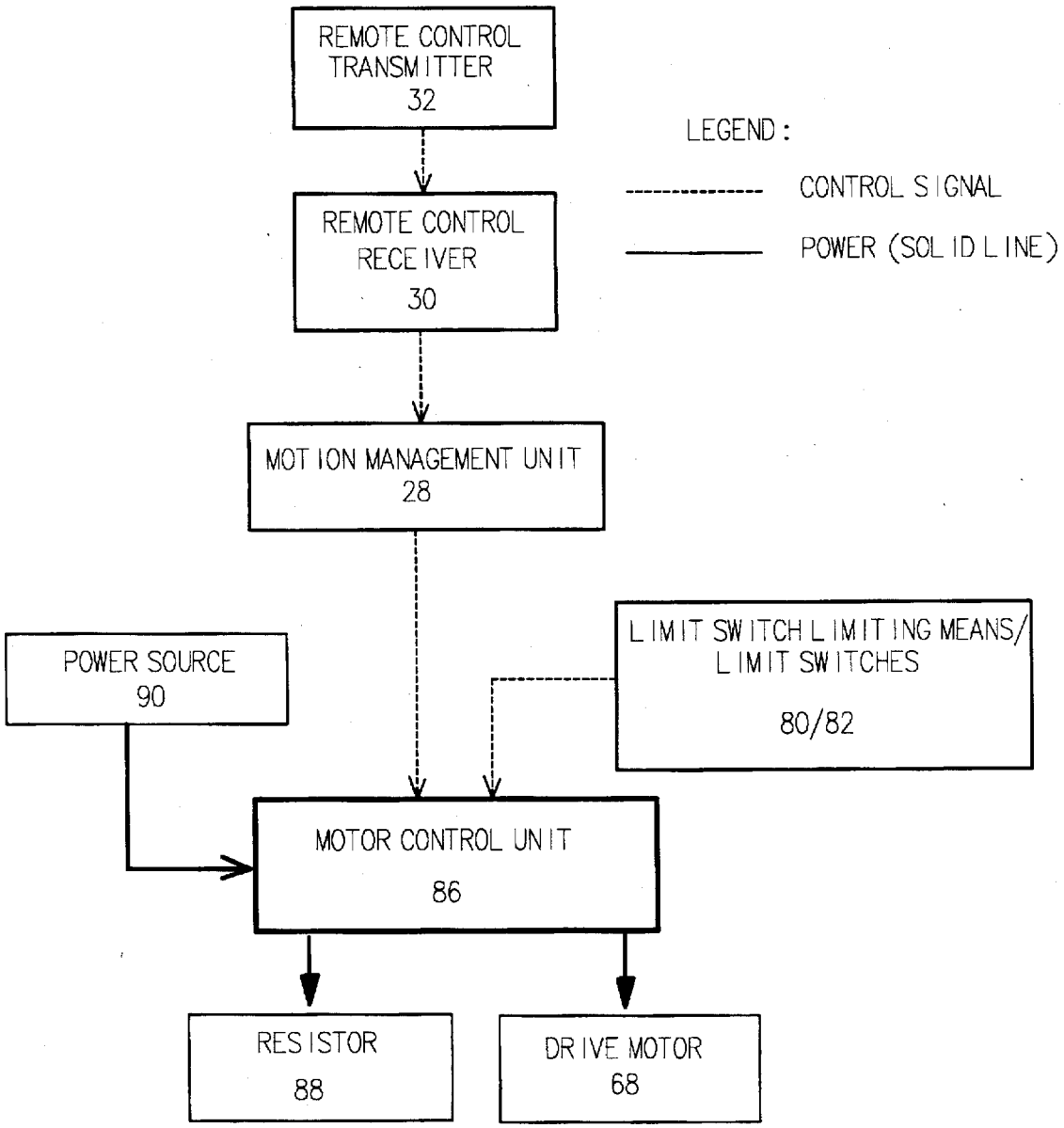
FIG. 9 is a schematic diagram of the control system for the invention.

Also shown on FIGS. 6 and 7 are the endless loop pulleys 42 that are used to guide the endless loop 18 from the endless drive wheel 84. In operation, as the endless drive wheel 84 turns the drive shaft 76 is also turns. This turning of the drive shaft 76 causes the threaded limit switch triggering means 80 to turn, and thus advancing the limit switch triggering means 80. Once the target 12 is near an end of the support cable 14, the limit switch triggering means 80 triggers one of the limit switches 82. The triggering of the limit switches 82 causes the motor control unit 86 to open the switch providing electrical power to the motor 68 and connects the motor 68 to the resistor 88 to provide baking as described above. FIG. 9 provides a schematic of the control system described herein.

Figure 10:
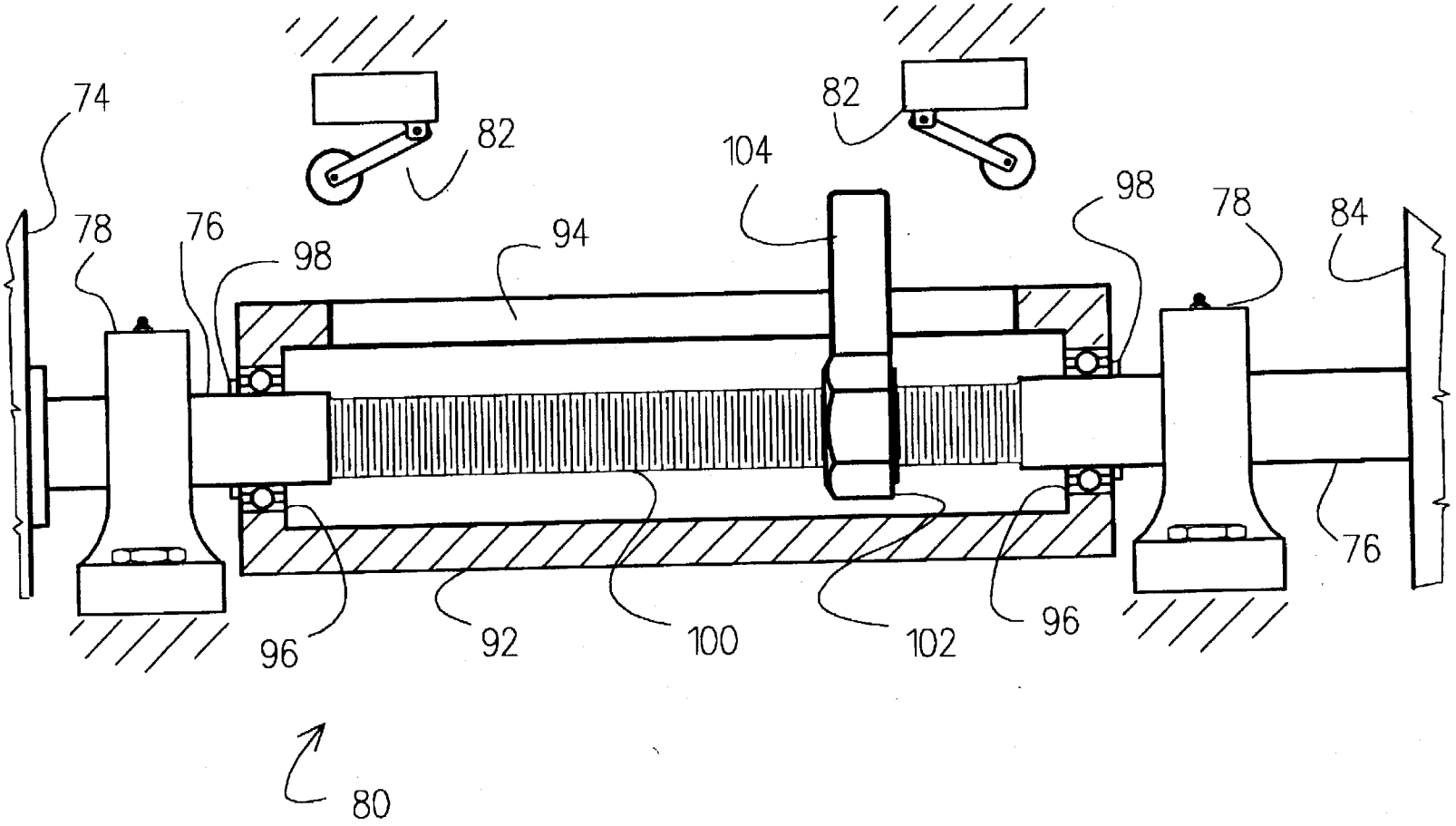
FIG. 10, is a sectional view of the limit switch triggering mechanism.

Turning now to FIG. 10, which shows a sectional view of the limit switch triggering means 80. As can be seen from FIG. 10, the triggering means 80 includes a cylindrical body 92, which can be made from a heavy gage pipe or the like. The cylindrical body 92 has a longitudinal slot 94, which can be milled on the cylindrical body 92, and mounts on the drive shaft 76 by means of bearings 96 between the driven pulley 74 and the endless loop drive wheel 84. The cylindrical body 92 is kept in position along the drive shaft 76 by means of keepers 98, and is rigidly attached to a support frame. While the drive shaft 76 has been shown supported by pillow block type shaft bearings 78, it is anticipated that the drive shaft 76 may be entirely supported by the cylindrical body 92.

The drive shaft 76 preferably includes a threaded portion 100 which resides within the cylindrical body 92, between the bearings 96. A threaded rider 102, which may simply be made from a nut having adequate thread, mounts over the threaded portion 100 of the drive shaft 76. Mounted on the threaded rider 102 is a trigger 104, which fits within the longitudinal slot 94 and extends beyond cylindrical body 92 so that it may interact with the limit switches 82.

In operation, as the drive shaft 76 turns, the position of the cylindrical body 92 and the bearings 96 is retained due to the attachment of the cylindrical body 92 to a stationary frame. Therefore, the longitudinal slot 94 also remains stationary while the drive shaft 76 rotates. As can be anticipated from the arrangement shown on FIG. 10, the rotation of the drive shaft 76 will cause the trigger 104 on the threaded rider 102 to move along the longitudinal slot 94 as the threaded portion 100 of the drive shaft 76 rotates relative to the threaded rider 102.

By causing the trigger 104 to move along the drive shaft 76 and triggering the limit switches 82 one can easily control the distance traveled by the target 12 before reversing its direction. As can be understood by examining FIG. 10, one can control the amount of travel of the target 12 by simply bringing the limit switches 82 closer to each other. Similarly, one can change the position along the support cable 14 at which the target 12 reverses direction of travel by simply manipulating the position of the limit switches 82 relative to the trigger 104.

While the invention has been particularly shown, described and illustrated in detail with reference to preferred embodiments and modifications thereof, it should be understood by those skilled in the art that the foregoing and other modifications are exemplary only, and that equivalent changes in form and detail may be made without departing from the true spirit and scope of the invention as claimed, except as precluded by the prior art.

What is claimed is:

1. A device for moving a target having a surface to be aimed at by an individual throwing an object at the target surface, the device comprising:

a support cable and means attaching a target to said support cable, said means attaching a target being adjustable on said support cable and having means for manual adjustment of said target surface to a desired angle relative to said support cable; means for allowing said means attaching to be pulled along said support cable; said means for manual adjustment comprising a stem portion connecting said target to said means attaching;

said stem comprising: a hollow upper stem portion attached to said support means, and a hollow lower stem portion attached to the target; spring means biasing said hollow lower stem portion against said hollow upper stem portion, so that adjustments of said angle of said target relative to said support cable means can be made by rotating said hollow lower stem portion relative to said hollow upper stem portion and so that said spring means will bias said hollow lower stem portion against said hollow upper stem portion so that a relative position between said lower stem portion and said upper stem portion is maintained when manually set; and means for moving said means attaching along said support cable, so that an individual may adjust said angle of said target relative to said support cable before said target is transported along said support cable, and so that said target surface will be at an orientation normal to a trajectory of an object thrown at said target when said target is at at least one position along the support cable.

2. A device according to claim 1 wherein said means for allowing said means attaching to be pulled along said support cable comprises:

a cable means attached to said means attaching to said support cable;

a motorized drive system for driving said cable means;

a receiver means for controlling said motorized drive system; and a transmitter for sending a control signal to said receiver means.

3. A device according to claim 2 wherein said target surface is substantially planar.

4. A device according to claim 3 wherein said target surface is defined by at least one plastic strip.

5. A portable, remote controlled, device for moving a target having a surface, the target surface to be aimed at by an individual throwing an object at the surface of the target, the device comprising:

at least two substantially vertical supports;

a support cable for supporting the target, said support cable being attached to and between said vertical supports;

means attaching said target from said support cable and having means for manual adjustment of said target surface to a desired angle relative to said support cable; said means for manual adjustment comprising a stem portion connecting said target to said means attaching;

said stem comprising: a hollow upper stem portion attached to said support means, and a hollow lower stem portion attached to the target; spring means biasing said hollow lower stem portion against said hollow upper stem portion, so that adjustments of said angle of said target relative to said support cable means can be made by rotating said hollow lower stem portion relative to said hollow upper stem portion and so that said spring means will bias said hollow lower stem portion against said hollow upper stem portion so that a relative position between said lower stem portion and said upper stem portion is maintained when manually set; and cable means for pulling said means attaching along said support cable, said cable means for pulling said means attaching being actuated by a drive motor actuated by remote control, so that an individual throwing an object at said target may adjust the angle of said target relative to said support cable before said target is transported along said support cable while on said means attaching, and so that said target surface will be at an orientation normal to a trajectory of an object thrown at said target when said target is at at least one adjusted position along said support cable, and so that the motion of said target may be actuated by remote control.

6. A portable, remote controlled, device for moving a target according to claim 5 wherein said drive motor actuated by remote control is electrically connected to a remote control receiver, and the remote control receiver is controlled by a portable remote control transmitter, so that a signal from the portable remote control transmitter activates the remote control receiver to electrically control the drive motor.

7. A portable, remote controlled, device for moving a target according to claim 6 wherein said target surface is substantially planar.

8. A portable, remote controlled, device for moving a target according to claim 7 wherein said target surface is defined by at least one plastic strip.

9. A portable, remote controlled, device for moving a target having a surface, the target being moved along a support cable supported by two substantially vertical supports, and to be aimed at by an individual throwing an object at the surface of the target, the device comprising:

means attaching said target from said support cable and having means for manual adjustment of said target surface to a desired angle relative to said support cable, said means attaching said target comprising a longitudinal body adapted for slidingly accepting said support cable; and said means for manual adjustment comprises:

a stem portion for supporting said target, said stem portion extending from said longitudinal body and comprising:

a hollow upper stem portion attached to said longitudinal body of said means attaching, and a hollow lower stem portion attached to said target;

a spring means for biasing said hollow lower stem portion to said hollow upper stem portion, so that adjustments of the angle of said target relative to said support cable means can be made by rotating said hollow lower stem portion relative to said hollow upper stem portion and so that said spring means will bias said hollow lower stem portion against said hollow upper stem portion so that the relative position between said lower stem portion and said upper stem portion is maintained when manually set; and cable means for pulling said target along said support cable, said cable means for pulling said target being actuated by a motor actuated by remote control, so that an individual throwing an object at said target may manually adjust the angle of said target relative to said support cable before said target is transported along said support cable, and so that said target surface will be at an orientation normal to a trajectory of an object thrown at said target when said target is at at least one adjusted position along said support cable, and so that the motion of said target along said support cable may be actuated by remote control.

10. A device according to claim 9 wherein said target surface is substantially planar.

11. A device according to claim 10 wherein said target surface is defined by at least one plastic strip.

* * * * *